United States Patent [19]

DeVore

[11] 4,177,854

[45] Dec. 11, 1979

[54] DOOR MOUNTING, OPENING AND LOCKING APPARATUS FOR BUILDINGS CONFORMING TO SLOPING TERRAIN

[76] Inventor: Wilfred H. DeVore, Box 75A Star Rt., Littleton, Colo. 80120

[21] Appl. No.: 749,469

[22] Filed: Dec. 10, 1976

[51] Int. Cl.[2] ..... E05D 15/26

[52] U.S. Cl. ..... 160/207

[58] Field of Search ..... 160/40, 113, 189, 193, 160/201, 207, 209; 52/169.4, 169.12, 92, 93, 183

[56] References Cited

U.S. PATENT DOCUMENTS

| | | | |
|---|---|---|---|
| 1,654,684 | 1/1928 | Earle | 52/169.4 |
| 2,093,020 | 9/1937 | Norberg | 160/201 |
| 3,103,969 | 9/1963 | Kitley | 160/193 |
| 3,474,578 | 10/1969 | Wippermann | 52/92 |
| 3,777,426 | 12/1973 | Weiner | 52/92 |

*Primary Examiner*—Peter M. Caun

*Attorney, Agent, or Firm*—Reilly and Young

[57] ABSTRACT

A structure for mounting and apparatus for opening, closing, and locking a large, overhead door is adapted for buildings constructed on terrain which is not level and having floor and overhead structures that conform to the terrain. A sloping overhead truss spans a door opening and includes a widened faceplate along the length of its span to accommodate mounting a large overhead opening door along a horizontal line between vertical columns. A combination manual and automatic electrically powered door opening apparatus includes a counterweight, a coil chain and sheave for manual operation which is interchangeable with an electrically powered motor for automatic operation, all connected to a common lift cable which applies substantially vertical lifting force to the lower edge of the door for opening. Bias means for causing initial folding of door sections for opening, and locking apparatus for resisting folding of the door sections to prevent opening are also provided.

8 Claims, 14 Drawing Figures

10'
10
13
41
10'
10
G
A
51
80
50
40
14
124
15
A
12

9
10
9
12
16
18
20
22
24
26
30
40
42
44
46
48
50
52
53
54
56
58
59
60
62
80
82
88
108
14

DOOR MOUNTING, OPENING AND LOCKING APPARATUS FOR BUILDINGS CONFORMING TO SLOPING TERRAIN

BACKGROUND OF THE INVENTION

This invention relates generally to large door structures and appurtenances, and more specifically to a large overhead opening door apparatus with suspension structure, combination manual and automatic powered opening mechanism and lock mechanism for buildings constructed to conform to sloping terrain.

Large overhead opening doors have been in use for some time in large building structures wherein opening a space of substantial size is necessary to allow entry and exit of large objects. A typical application for such large doors is in airport hangars wherein the door space must be large enough to accomodate entry and exit of aircraft. Since the doors are quite large, an ever pervading problem involves opening and closing the doors. This problem is compounded if the building is built on terrain that is not level and with a floor that conforms to such terrain, which is often ecomonically feasible especially for relatively long buildings such as hangars which would require a considerable amount of excavation and fill to provide a level floor, not to mention the otherwise required artificial grading of the surrounding parking aprons and approaches to the hangar. It is also desirable to have a suitable locking mechanism to prevent the large doors from being opened by unauthorized personnel or adverse wind conditions. The present invention provides door apparatus for aircraft hangars which are built with structures and floors that conform to sloping terrain on which they are built and which can be readily opened and closed both manually and automatically and which can be locked in the closed position when not in use.

SUMMARY OF THE INVENTION

Accordingly, it is an object of the present invention to provide a large door apparatus which can be suspended from an overhead structure of a building which is not level, yet which can be opened and closed by raising and lowering respectively without binding.

Another object of the present invention is to provide a large door with two sections hinged together for folding up when the door is opened, the top of the door being pivotally attached to the building structure and the bottom of the door being confined to travel in a vertically straight plane, and hinged connection of the two sections to each other near the center of the door, the two sections beind pivotally movable outwardly and upwardly to an open position wherein the top and bottom sections are folded toward each other.

Yet another object of the present invention is to provide a lock mechanism which prevents the hinged seam between the two sections of the door from moving outwardly and thereby locking the door in the closed position.

A further object of the present invention is to provide a combination door opening apparatus which can be operated manually or alternatively which can be power operated automatically.

This invention comprises a door structure, closing and opening means, and locking means for installation and use in a building which has a floor and overhead structure conforming to ground terrain that is not level. The lateral sides of the building include vertical columns of approximately equal length extending upwardly from the ground for supporting the overhead structure and roof of the building. The overhead structure of the building is attached on the top of each column respectively, therefore, the overhead structure of the building which spans the distance between each column is not level and does not form a right angle with the respective columns. Consequently, the openings in the building, which is defined by a pair of spaced-apart vertical columns on each side, the floor of the building on the bottom, and the spanning overhead structure on the top, is not rectangular, but rather it is a parallelogram. This invention provides an apparatus whereby a door which opens by folding upwardly can be suspended from the sloping overhead structure to open and close in a parallelogram-shaped doorway without binding either within the structure of the door itself or with the columns on either side of the doorway.

Opening means is provided to lift and cause the bottom edge of the lower section of the door to move upwardly in a vertical plane while the top and bottom sections pivot outwardly with respect to the building. The lift means can be easily operated manually or alternatively with a motor without any requirement of connecting or disconnecting either the manual or the power drive. Since the top of the upper section and the bottom of the lower section are confined within the same vertical plane, any upward movement of the lower section must be accompanied by laterally outward movement of the hinged seam between the upper and lower sections of the door. Since the lift means applies a force to the bottom of the lower section of the door directed substantially in a vertical direction, bias means are also provided to initially urge the hinged seam between the upper and lower sections in a laterally outward direction to prevent damage to the door or lifting mechanism when the initial vertical lifting force is applied by the lift means. A strong, durable, locking mechanism is also provided which prevents laterally outward movement of the hinged seam and thereby locks the door to prevent opening.

DESCRIPTION OF THE DRAWINGS

Other objects, advantages and capabilities of the present invention will become more apparent as the description proceeds, taken in conjunction with the accompanying drawings, in which.

DESCRIPTION OF THE PREFERRED EMBODIMENT

Figure 1:
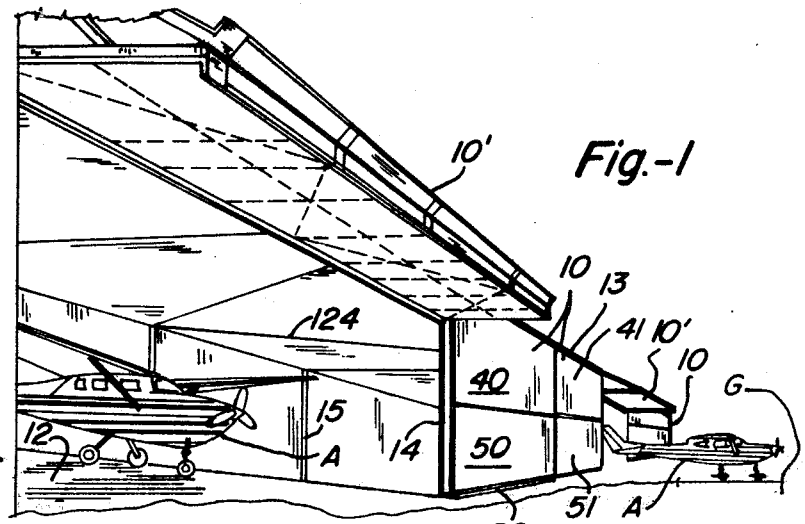
FIG. 1 is a perspective view of the side of an aircraft hanger which is built with a floor and overhead structure that conforms to the underlying ground that is not level, and also showing the large doors which are the subject of this invention.

A building in the form of a hangar H with large overhead folding doors 10 to provide access for shelter and repairs for airplane A, as illustrated in FIG. 1, embodies the door suspension structure, opening and closing apparatus, and locking means of the present invention. The door structure and opening and closing apparatus of the present invention is particularly appropriate for use in such a hangar H which is constructed on ground G that is relatively uniform but not level and with a floor 12 that conforms to the terrain of ground G.

The large overhead doors basically include an upper section 40 with a metal or fiberglass skin 41 and a lower section 50 with a metal or fiberglass skin 51. As will be discussed below in more detail, the upper section 40 is hinged to the overhead structure of the hangar H, and lower section 50 is attached by hinges to the upper section 40. A tapered rubber shoe or spacer 80 is affixed to the bottom of the lower section 50 to conform to the sloping floor 12 for a weather-tight seal.

Figure 2:
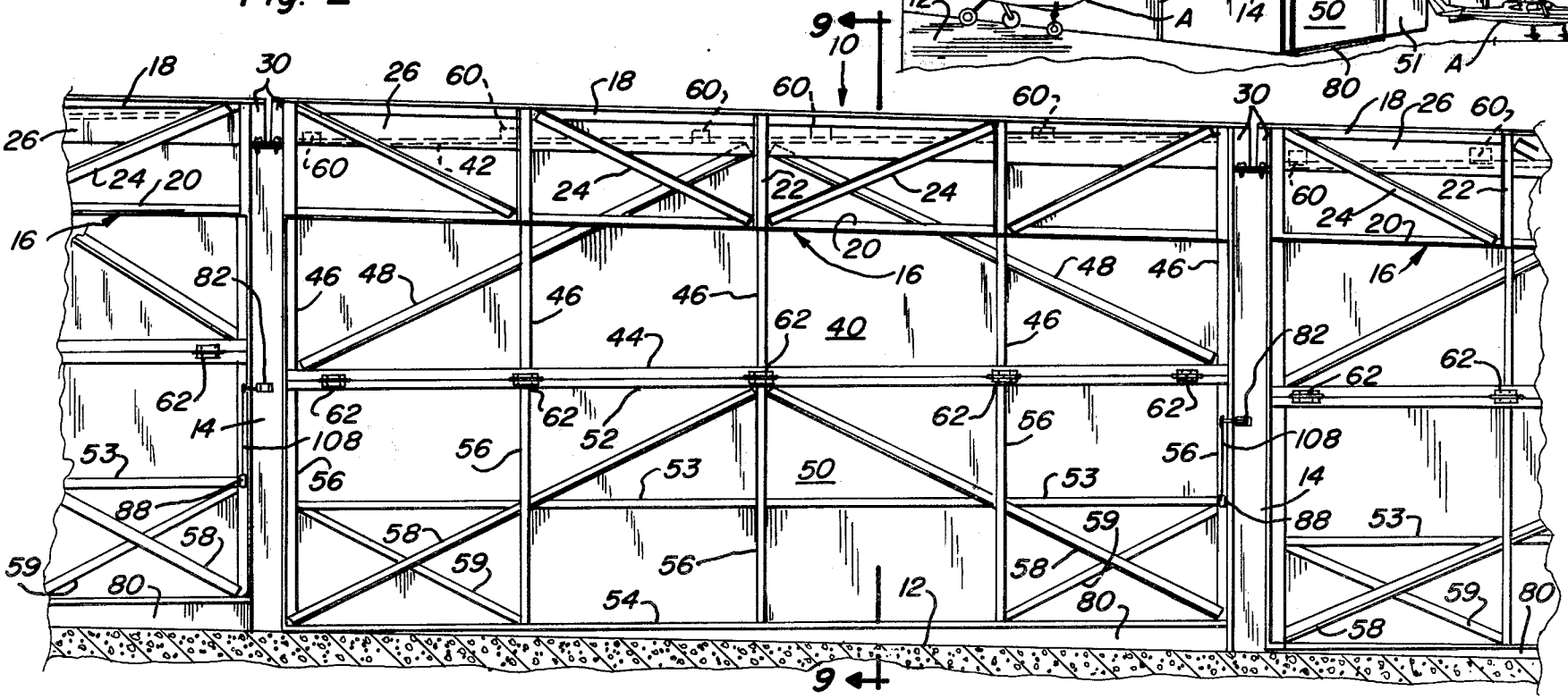
FIG. 2 is a view of one of the large doors taken from the inside of the hanger and showing the trapeziodal shape of the opening (perhaps somewhat exaggerated to better illustrate the concept of the invention)
Figures 3, 4, 5:
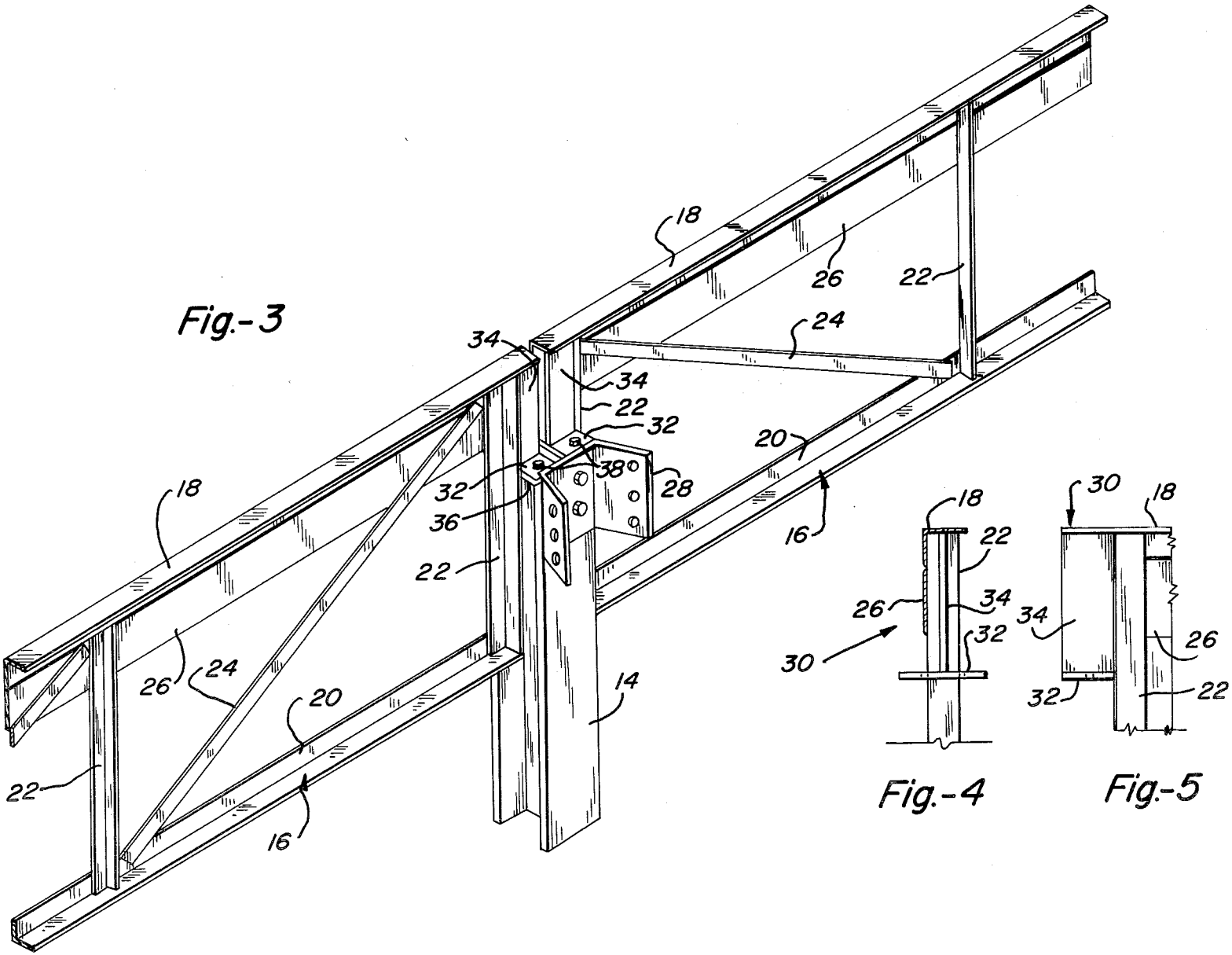
FIG. 3 is a perspective view which shows portions of adjacent overhead trusses which span the door openings illustrating the connection of the trusses to a vertical column.
FIG. 4 is an end view of the chair used to connect the truss to the column.
FIG. 5 is a side view taken from the inside of the building of the chair shown in FIG. 4.

The structure of the door 10 and the structural portion of the hangar H which forms the door opening is shown in FIG. 2. The door opening is defined on the sides by the space between the two vertical structural columns 14 of the hangar H, on the top by the overhead truss 16, and on the bottom by the concrete floor 12. As can be seen in FIG. 2, perhaps somewhat exaggerated for illustrative purposes, the concrete or asphalt floor 12 is not level but conforms to the terrain of ground G. The columns 14 extend vertically in equal distances above the floor 12, and the overhead truss 16, which is supported on each end by the respective columns 14, slopes at the same angle as the floor 12. Consequently, the door opening is slightly parallelogram in shape.

The door 10 is of rectangular configuration and is comprised of an upper section 40 pivotally attached by hinges 62 to a lower section 50. The upper section 40 includes an upper horizontal beam 42, a lower horizontal beam 44, vertical studs 46, and diagonal braces 48. Likewise, the lower section 50 includes an upper horizontal beam 52, a lower horizontal beam 54, vertical studs 56, and diagonal braces 58. The lower section 50, being somewhat larger than the upper section 40, also includes an intermediate horizontal beam 53 and diagonal corner braces 59.

The door 10 illustrated in FIG. 2 is in closed position. When it is opened, the lower section 50 is folded or pivoted on hinges 62 toward the upper section 40 so that in full open position, both the upper and lower sections 40 and 50 approach substantially horizontal orientation near the overhead structure of the hanger H as illustrated in FIG. 1 by the designation 10'. This full open position is also shown in phantom lines 10' in the elevational view of FIG. 6. The door 10 is raised or opened by lifting vertically on the lower horizontal beam 54 of the lower section 50. When such a lifting force is applied, the lower edge or beam 54 of the lower section 50 moves vertically upward in a vertical plane between the columns 14 while the upper edge or beam 42 of the upper section 40 pivots in relation to the overhead truss 16 allowing the lower edge or beam 44 of upper section 40 and the upper edge or beam 52 of lower section 50 to move in an arcuate path upwardly and outwardly to the open positions shown in FIGS. 1 and 6.

It can be appreciated that if the door was also shaped in a parallelogram configuration conforming to the door opening or if a rectangular door was mounted on a slant to conform to the sloping floor 12 and the overhead truss 16, the relative movement of the door sections to the structural members of the hangar H would result in excessive binding or wedging of the respective parts and would therefore not operate satisfactorily. Consequently, even though the hangar H structure conforms to the contour of the ground G, the door 10 must still be oriented and hung from the overhead structure along a horizontal line so that it can be lifted vertically upward between the vertical columns 14 without excessive binding or wedging. It is a significant feature of this invention to provide a truss system which can be oriented on a slant between two vertical columns 14, yet which can accomodate the pivotal attachment of the upper edge or beam 42 of a door 10 along a horizontal line. To accomplish this purpose, a truss 16 with an upper gently sloping member 18, a lower gently sloping member 20, upright members 22 and diagonal members 24, is supported by chairs 30 between two vertical columns 14 as best seen in FIGS. 2-5. The upper and lower members 18, 20 are oriented substantially parallel to the sloping floor 12 of the building. Each chair 30 includes a web 34 extending upwardly from a base plate 32. The chair 30 supports the end of the upper member 18 of truss 16, and is mounted on a bearing plate 36 on top of column 14 and secured by bolts 38. In this manner the truss 16 is supported at each end near the top of the respective columns 14 with the end upright members 22 of each truss 16 being adjacent but unattached to the respective columns 14 in such a manner that the truss 16, when oriented parallel to the floor 12 of the hangar H is at either a slight acute or obtuse angle, depending on the slope, to the respective columns 14.

A fairly wide face plate 26 is affixed to the top of the truss 16 immediately under the upper member 18, e.g., by welding, to provide a surface on which the upper edge or beam 42 of the door 10 can be attached in a horizontal line in spite of the overall sloped orientation of the truss 16.

The upper edge or beam 42 of the door 10 is shown in FIG. 2 in phantom lines attached in a horizontal orientation to the mounting plate 26 by hinges 60. As can best be seen in FIG. 9, the door 10 is hung from the truss 16 by a 90-degree hinge 60, one leg of which is affixed to the mounting plate 26, the other leg of which is affixed to the upper beam 42 of the door 10, whereby the upper section 40 of the door 10 can be pivoted around hinge 60 outwardly in relation to the truss 16.

Figure 9:
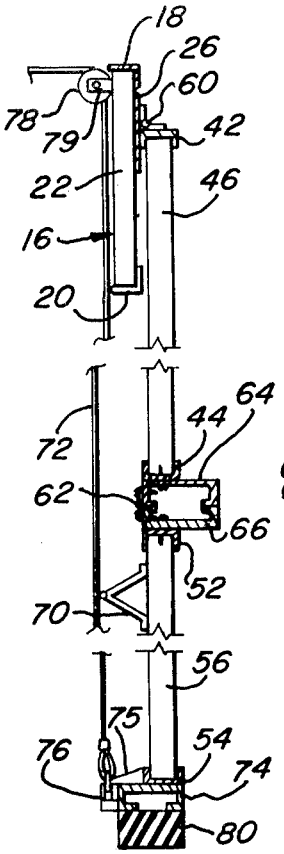
FIG. 9 is a sectional fragmentary view of the door taken along lines 9—9 of FIG. 2, illustrating the means for hanging the door, and the means for lifting the door, including the hinged seam between the upper and lower sections with the cable activated bias means.

FIG. 9 also shows in cross-section the pivotal attachment of the upper section 40 of the door 10 to the lower section 50, as well as the attachment of the lift cable 72 to the door 10. The upper section 40 is provided with an interfacing channel member 64 affixed to the lower horizontal beam 44 with the open side of the channel 64 facing downward. The lower section 50 is also provided with a similar interfacing channel 66 affixed the upper horizontal beam 52 with its open side facing upwardly in communication with the downwardly facing side of the intefacing channel 64 on the upper section 40 of the door 10. The inside edges of the respective interfacing channels 64, 66 are pivotally attached together by hinges 62 such that the outside edges of the respective interfacing channels, 64, 66 will separate as the upper and lower sections 40 and 50, respectively are pivoted toward one another when the door is raised or opened as shown in phantom lines in FIG. 6.

Also shown in FIG. 9, is a footing channel 74 affixed beneath the lower horizontal beam 54 of the lower section 50. A lift cable 72 as trained over a fairlead sheave 78 which is attached to the overhead truss 16 in spaced relation to the inside of the door 10, the cable descending along the door and attached at its lower end to the footing channel 74 by a lift bracket 75 and shackle 76. Near the top of the door 10 the cable passes over the fairlead sheave 78 which is attached to truss 16 by yoke 79, and from there extends substantially horizontally toward lifting means generally designated 125 where it is attached to a roller chain 110 as will be hereinafter described in more detail.

A straight vertical force was applied to the bottom of the door 10 when it is in the down or closed position it would only result initially in a force which tends to squeeze the intefacing channels 64, 66 together but would have no horizontal component of force to urge the hinged seam comprised of the lower edge 44 of upper section 40 and the upper edge 52 of lower section 50 outwardly. Consequently, a straight vertical lifting force on the lift cable 72 could result in damage to the door or to the lifting means. To alleviate this potential damage, a strut 70 can be attached to the lower section 50 of the door 10 extending inwardly into contact with the lift cable 72. The strut 70 extends inwardly far enough to distort the lift cable 72 out of a straight line between the shackle 76 and fairlead sheave 78. Consequently, when a vertical lift force is applied, the cable 72 will also exert a horizontal force component on the lower section 50 through strut 70, resulting in an initial urging of the hinged seam outwardly at the start of the lifting operation. Once the initial outward urging is accomplished, continued vertical force applied to the bottom of the door 10 through lift cable 72 results in the pivotal movement of the door sections as described above to the open position.

Figure 10:
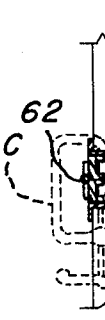
FIG. 10 shows an alternative embodiment of the hinged seam of the door wherein the biased means is induced by prestressing the hinged joint.

An alternative initial bias means for starting the pivotal movement of the upper and lower sections 40 and 50 in relation to each other is illustrated in FIG. 10, wherein the inside edges of the interfacing channels 64, 66 are prestressed, such as with a C-clamp C shown in phantom lines, while the hinges 62 are being attached. Once the hinges 62 are attached, the C-clamp C can be removed, and the prestressed condition will urge the respective interfacing channels 64, 66 in a direction to spread their respective outer edges apart from each other. Consequently, when a vertical lifting force is initially applied to the bottom of the door, the upper and lower sections 40 and 50, respectively, will easily pivot around hinges 62 in relation to one another toward the open position.

Figure 11:
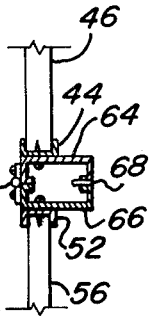
FIG. 11 illustrates still another embodiment of bias means in the hinged seam joint of the door with a spacer plate in the opening side of the seam.

Still another alternative bias means for accomplishing this initial pivoting relation between the upper and lower sections of the door is illustrated in FIG. 11, wherein a spacer strap 68 is sandwiched between the respective outer edges of interfacing channels 64, 66. This spacer 68 also serves the function of providing an initial bias tending to pivot the upper and lower sections 40 and 50 around hinge 62 with respect to each other when the initial vertical lifting force is applied to the bottom of door 10.

Figure 8:
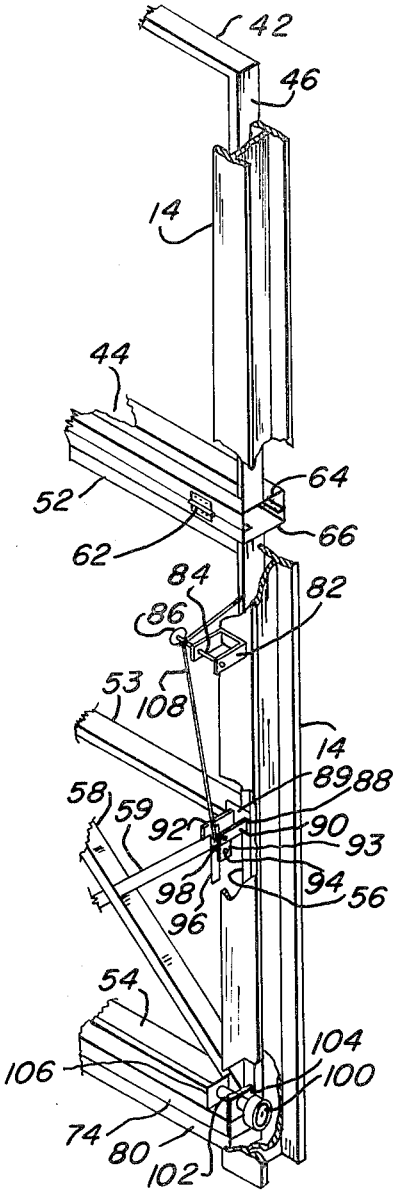
FIG. 8 is a perspective view of an end portion of a door in closed position taken from the inside of the building showing the guide wheel and locking mechanism in relation to the column.
Figure 14:
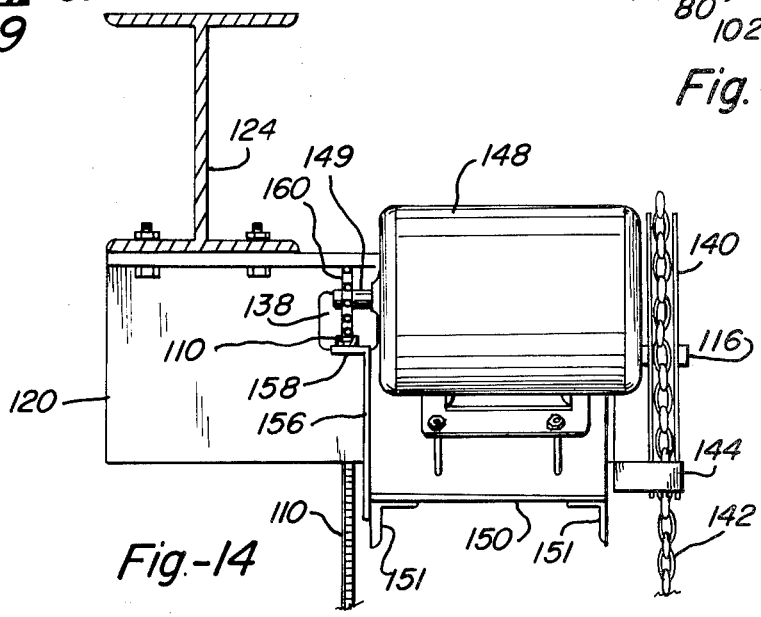
FIG. 14 is an elevation view of the front of the lift mechanism.

Guide rollers 100 extend from the lower corners of the door into engagement with channels in the wide flange steel columns 14, as best seen in FIG. 8, to maintain non-binding upward movement of the lower edge of the door in a vertical plane between the columns 14. Each roller 100 is mounted on an axle 102 and supported by front and rear plates 104, 106, respectively, on the footing channel 74.

A locking device is also shown in FIG. 8 which is comprised of a lock cable 108 attached at its upper end to the vertical end member 22 of upper section 40, and which is attached at its lower end to a tightener apparatus affixed to the vertical end member 56 of lower section 50. The mid-section of the cable 108 is passed over a shaft 84 supported in inwardly spaced relation to the door by a U-shaped bracket 82 attached to the column 14. Consequently, when the lock cable 108 is tightened over the shaft 84, it exerts an inwardly directed lateral force on the door which counteracts the initial bias force placed on the interfacing channel 64, 66, as discussed above, and thereby prevents the door from being opened. A keeper 86 is also provided on the face end of shaft 84 to prevent the lock cable 108 from slipping off the shaft 84.

The tightener is comprised of a yoke 88 with a right leg 90 and a left leg 92 extending from a plate 89 which is mounted on vertical member 56 of the lower section 50 of door 10. A shackle 93 with two-spaced apart arms 94,96 is pivotally mounted between the legs 90, 92 of the yoke 88. A cross pin 98 extends between and connects the arms 94, 96 at a spaced distance outwardly from their pivotal connection with the yoke 88. This cross pin 98 serves as the anchor on which the lower end of the lock cable 108 is attached to the shackle 93. The arms 96 also has an elongated extension to serve as a handle for the shackle 93 of the lock mechanism. Thus, when the shackle 93 is rotated downwardly and toward the door, the pin 98 applies a tension force to the cable 108 tightening the cable over the shaft 84 of bracket 82 to resist any outward pivotal movement of the upper and lower sections 40, 50 of the door 10 thereby preventing opening. It can also be appreciated that the specific spaced relation of the parts on the cable tightener, including the length of the extending legs 90, 92 of yoke 88, the point of pivotal attachment of the arms 94, 96 of schakle 93 to the yoke 88 and the location of the pin 98, when the handle 96 is rotated the full distance downwardly and toward the door, an "over-the-center" bias is maintained on the shackle 93 to retain the lock cable 108 in tensioned condition. When the handle 96 is rotated outwardly and upwardly, however, the tension on the lock cable 108 is released, and the door 10 is allowed to open.

As also described above, the door 10 is opened by an upwardly directed force on the lift cable 72. Another significant feature of this invention is the lift means 125 for applying the lifting force on the lift cable 72. Of course, it is usually advantageous to provide a power lift means for convenience; however, it is also frequently necessary to have a manual lift means available for use in opening the door, for example, when there is a disruption in the available power source, or when the power lift means is in need of repair. Consequently, this invention includes a combination power and manual lift means utulizing common components for ecomony, yet either of which can be selectively operated without interferring or requiring disconnection of the other.

Figures 6, 7:
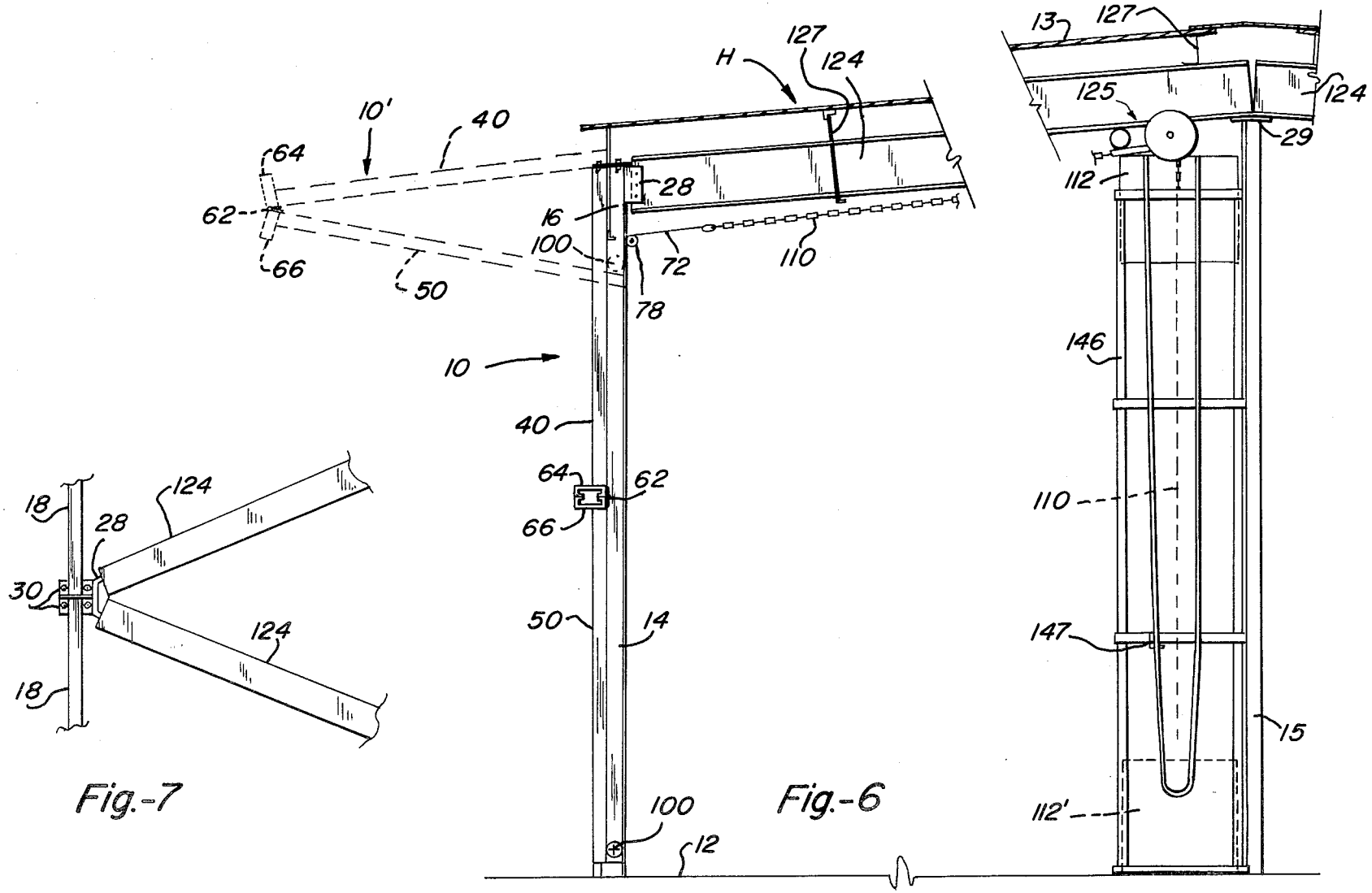
FIG. 6 is an elevation side view of the building structure showing the columns, the overhead structure, the door in closed position, the door opening mechanism, and the door in opened position being shown in phantom lines.
FIG. 7 is a plan view showing the connection of overhead girders to a column.

A sectional elevational view of the hangar H structure is shown in FIG. 6, including floor 12, outside columns 14, inside columns 15, girders 124 supported on their outer ends by gusset plate 28 attached to column 14 and on their inner ends by the bearing plate 29 at the top of column 15. A roof 13 is also shown supported over girders 124 by perlins 127. The lift means 125 is suspended under a girder 124, as best seen in FIGS. 6, 12, 13 and 14.

Since as access door for hangars of the size indicated in this description is relative heavy, the lift means includes a cog-like roller chain 110 attached at one end to the lift cable 72 with its opposite end trained over and positively internesting with teeth 113 on a sprocket 114; and a counterweight 112 is suspended from said opposite end of said roller chain. The counterweight 112 has sufficient weight to apply a force to the lift cable of approximate magnitude equal to that required to maintain the door 10 in a stable, non-moving position. Consequently, in order to raise or open the door, a sufficient increment of additional force must be applied to the lift cable 72 by either power or manual means to overcome the momentum and frictional forces of the door. The counterweight is however of sufficient weight to hold the door in any position including and between the positions of fully open and fully closed.

Figure 13:
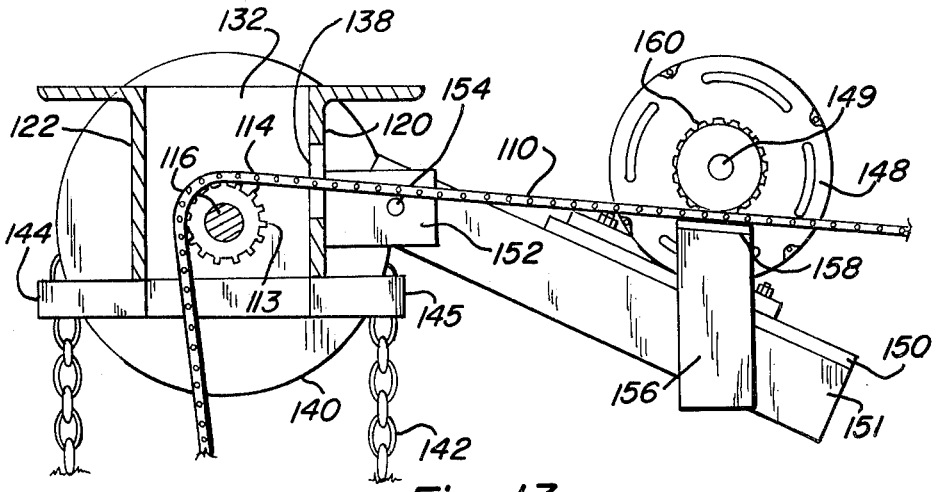
FIG. 13 is a side elevation in section of the door lifting means taken along the line 13—13 of FIG. 12 as shown from the opposite of that illustrated in FIG. 6.
Figure 12:
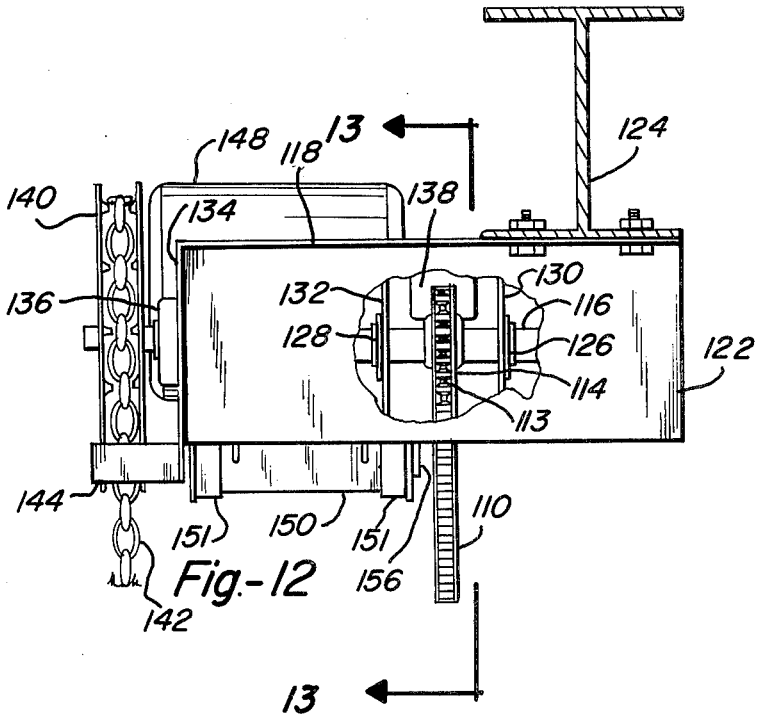
FIG. 12 is an elevational view of the back of the lift mechanism.

The manual lift mechanism, as best viewed in FIGS. 6, 12 and 13, includes an endless coil or pull chain 142 trained over and engaged with mating sheave 140 which is connected to a rotatable shaft 116 journaled within a bearing housing 118. The sprocket 114 located within the bearing housing 118 is also attached to the rotatable shaft 116 such that rotation of the sheave 140 causes the sprocket 114 to rotate and drive the roller chain with its teeth 113 in either direction. Consequently, when sufficient manual force is applied to the chain 142 to provide that additional increment of force on the lift cable 72 necessary to open the door, the sheave 140 will rotate causing the shaft 116 and sprocket 114 to rotate and to pull the lift cable 72 upwardly to open the door 10. A safety latch, such as a slotted angle iron, can be affixed to the cage 146 for releasably securing the coil chain 146 against movement, thus restraining movement of the door 10 at any desired position.

The bearing housing 118 includes a front side 120, with a hole 138 through which roller chain 110 enters the bearing housing 118, a rear side 122, internal bearing supports 130, 132 with bearings 126, 128, respectively, on opposite sides of sprocket 114 for supporting shaft 116, an end plate 134, and an end bearing 136 for supporting the end of shaft 116 on which the sheave 140 is mounted. The coil chain 142 is endless and is of sufficient length to hang near the floor 12 of the hangar H so that it can be conveniently reached and grasped by a person standing on the floor. Chain guides 144, 145 extend from the bearing housing 118 into radially spaced relation to the sheave 140 on either side of the coil chain 142 to prevent the coil chain 142 from disengaging or jumping off of sheave 140. The counterweight 112 which is suspended from lower chain 110 as described above, moves from a position in proximity to the bearing housing 118 as illustrated in FIG. 6 when the door is closed to a position near the floor 112 as indicated in phantom lines 112' when the door is fully opened as indicated in phantom lines 10'. A cage 146 is provided to guide the counterweight 112 in a vertical line between its upper and lower positions and to provide a safety barrier to prevent persons from inadvertantly walking or standing beneath the counterweight when it is descending as the door is being opened.

A power-assist mechanism is also provided as an alternative to applying manual force to raise or open the door 10. The power-assist mechanism essentially includes an electric motor 148 with a drive sprocket 160 attached on its drive shaft 149. The electric motor is pivotally mounted on the front side 120 of the bearing housing 118 such that the weight of the motor 148 urges the drive sprocket 160 into engagement with the roller chain 110. Consequently, the motor can also apply a sufficient incremental force to the lower chain 110 in addition to the force applied by the counterweight 112 to open the door 10. Of course, running the motor in a reverse direction results in closing the door. Manual operation of the door as described above while the motor is de-activated results in the roller chain 110 merely causing the armature of the motor 148 to rotate, but this rotation does not materially interfere with the manual operation of the door lift means.

The motor mount includes a frame 151 comprised of a pair of parallel, spaced-apart angle irons, each of which is pivotally attached by pin 154 to an ear 152 extending from the front side 120 of the bearing housing 118. A mounting plate 150 extends between the angle irons of frame 151 and provides a surface on which the motor is secured. A roller chain guide 158 is supported in close radially spaced relation under the peripheral surface of the drive sprocket 160 by a leg 156 rigidly attached to the side of the motor mount. The space between the guide 158 and the drive sprocket 160 is sufficient to accomodate the passage of the roller chain therebetween, but is close enough to prevent the roller chain 110 from becoming disengaged from the drive sprocket 160. Even though the weight of the motor acting downward through the drive sprocket 160 on the roller chain 110 provides the primary engaging force, as described above, the guide 158 prevents the teeth of the sprocket 160 from jumping or slipping alternately in and out of engagement with the lower chain.

Although the present invention has been described with a certain degree of particularity, it is understood that the present disclosure has been made by way of example and that changes in details of structure may be made without departing from the spirit thereof.

What is claimed is:

1. Door apparatus adapted for use in a building that is constructed with a floor and an overhead structure, both of which slope from the horizontal, comprising:

two structural columns extending upwardly from said floor in parallel, spaced apart, relation to each other, said columns being oriented vertically but not perpendicular to the floor and defining a door space between them and each having on its upper extremity a flat bearing plate;

a header truss supported at each end over the door space by said columns above and substantially parallel to the sloping floor of a building and spanning the door space, said truss including an upper member and a lower member in parallel, spaced-apart relation to each other, both of said upper and lower members being oriented parallel to said floor and on a slope away from horizontal, a plurality of intermediate structural brace members attached between said upper and lower members, and bracket means at each end of said truss connected to and extending downwardly from said upper member of said truss and mounted on said bearing plate on the upper end of said column for supporting said truss over said column and adapted to conform to the angle between the upper member of said truss and said column when a load is applied thereto;

a flat elongated rectilinear face mounting plate rigidly attached to said truss on said intermediate brace members between and substantially parallel to said upper and lower members but not extended over the entire span of said truss, the width of said mounting plate being sufficiently large such that all points of a straight horizontal line lay on said plate; and hanger means attached to said mounting plate along said straight, horizontal line and adapted for suspending a door in said door space.

2. The door mounting apparatus of claim 1, wherein said hanger means is in the form of a plurality of hinges attached to said mounting plate in spaced-apart relation to each other along said straight, horizontal line and adapted to pivotally attach the upper edge of a door to said mounting plate.

3. The door mounting apparatus of claim 2, wherein said mounting plate is attached to said truss substantially parallel to said upper and lower members and being of sufficient width such that said straight horizontal line in which said hinges are positioned is entirely on said plate.

4. The door mounting apparatus of claim 2, wherein said bracket means includes a chair bracket comprised of a rigid, vertical strut rigidly affixed to and extending downwardly from the end of said upper member of said truss a distance less than the distance between said upper and lower members, and a base plate on the lower end of said strut adapted to interface with and be connected to said bearing plate on the upper end of said column.

5. Door apparatus adapted for use in a building that is constructed with a floor and an overhead structure, both of which are parallel to each other and slope away from the horizontal, comprising:

a first frame member extending vertically upward from said floor, and a second frame member extending vertically upward from said floor in parallel, spaced-apart relation to each other, each of said first and second frame members having a longitudinal channel extending along its side and opening toward the other of said frame members;

an elongated header truss which constitutes a part of the overhead structure of said building, said truss having an upper elongated structural member of a length approximately equal to the distance between the longitudinal axes of said first and second frame members, a lower elongated structural member positioned in parallel, spaced-apart relation under said upper member, said lower member being shorter than said upper member and of a length less than the distance between said first and second frame members, and intermediate structural members attached between said upper and lower members, said truss being positioned to span the distance between said first and second frame members with respective ends of said upper member being positioned over the respective upper ends of said first and second frame members, and with said lower member extending between the respective lateral surfaces of said frame members, and the longitudinal axes of said upper and lower members being sloped away from horizontal;

first support means affixed to and extending upwardly from the upper end of said first frame member and on which one end of said upper member is positioned for support, and second support means affixed to and extending upwardly from the upper end of said second frame member and on which the other end of said upper member is positioned for support;

a bifold door positioned between said first and second frame members, said door having guide means along its sides for engaging said channels in said first and second frame members to maintain said door in proper working position and alignment between said first and second frame members;

an elongated, rectilinear face mounting plate rigidly affixed to said intermediate structural members of said truss and extending the length of said truss in parallel relation to said upper and lower members and having sufficient width such that a horizontal line of a length approximately equal to the distance between said first and second frame members lays entirely on said mount plate; and door hanger means attached to said mounting plate in a horizontal line for suspending said door in the space between said first and second frame members.

6. The door apparatus of claim 5, wherein said first and second support means are each comprised of a flat base plate attached to the upper end of said respective frame member and a strut member affixed to and extending upwardly from said base plate, the respective end of said upper member of said truss being attached to and supported on said strut member, and said respective frame member includes a flat bearing plate affixed to its upper end for interfacing with and supporting said base plate of said support means.

7. The door apparatus of claim 6, wherein the lengths of said first and second frame members above the floor are equal to each other, and said upper and lower members of said truss are substantially parallel to the floor but not perpendicular to said frame members.

8. The door apparatus of claim 7, wherein said door hanger means include a plurality of hinges attached to the top edge of the door and to said mounting plate in spaced-apart relation to each other along a horizontal line that is perpendicular to said frame members but not perpendicular to said upper and lower members of said truss.

* * * * *